US005791423A

United States Patent [19]

Overstreet et al.

[11] Patent Number: 5,791,423

[45] Date of Patent: Aug. 11, 1998

[54] EARTH-BORING BIT HAVING AN IMPROVED HARD-FACED TOOTH STRUCTURE

[75] Inventors: James L. Overstreet, Webster; Ronald L. Jones, Cleveland, both of Tex.

[73] Assignee: Baker Hughes Incorporated, Houston, Tex.

[21] Appl. No.: 690,887

[22] Filed: Aug. 2, 1996

[51] Int. Cl.[6] ..... E21B 10/16; E21B 10/50

[52] U.S. Cl. ..... 175/375; 76/108.4

[58] Field of Search ..... 175/374, 375, 175/431; 76/108.2, 108.4

[56] References Cited

U.S. PATENT DOCUMENTS

| | | | |
|---|---|---|---|
| 2,660,405 | 11/1953 | Scott et al. | 175/375 |
| 3,800,891 | 4/1974 | White et al. | 175/374 |
| 5,131,480 | 7/1992 | Lockstedt et al. | 175/374 |
| 5,445,231 | 8/1995 | Scott et al. | 175/374 |
| 5,492,186 | 2/1996 | Overstreet et al. | 175/374 |
| 5,579,856 | 12/1996 | Bird | 175/375 |

*Primary Examiner*—David J. Bagnell
*Attorney, Agent, or Firm*—James E. Bradley

[57] ABSTRACT

An earth-boring bit has a bit body and at least one cutter rotatably secured to the bit body. The cutter includes a plurality of teeth formed integrally with the cutter and arranged in circumferential rows. Each tooth has inner and outer ends, leading and trailing flanks, and a crest transversely connecting the ends and flanks. A thickness of wear-resistant material is applied over the crest and at least a portion of the ends and flanks of the tooth. An extending layer of wear-resistant material is applied at the intersection of the leading flank and the outer end to provide twice the hard-facing thickness and increased wear-resistance in that area of the tooth that is subjected to the greatest wear.

13 Claims, 2 Drawing Sheets

EARTH-BORING BIT HAVING AN IMPROVED HARD-FACED TOOTH STRUCTURE

BACKGROUND OF THE INVENTION

1. Field of the Invention

The present invention relates generally to the tooth structure of earth-boring bits of the rolling cutter variety. More particularly, the present invention relates to improving the wear-resistance of mill- or steel-tooth earth-boring bits.

2. Background Information

The success of rotary drilling enabled the discovery of deep oil and gas reservoirs. The rotary rock bit was an important invention that made that success possible. Only soft formations could be commercially penetrated with the earlier drag bit, but the original rolling-cone rock bit invented by Howard R. Hughes, U.S. Pat. No. 939,759, drilled the hard caprock at the Spindletop Field, near Beaumont, Tex., with relative ease.

That venerable invention, within the first decade of this century, could drill a scant fraction of the depth and speed of the modern rotary rock bit. If the original Hughes bit drilled for hours, the modern bit drills for days. Bits today often drill over a mile. Many individual improvements have contributed to the impressive overall improvement in the performance of rock bits.

The early rolling-cone earth-boring bits had teeth formed integrally with the cutters. These bits, commonly known as "steel-tooth" or "mill-tooth" bits, are still in common usage for penetrating relatively soft formations. The strength and fracture-toughness of the steel teeth permits relatively long teeth with long crests, which provide the aggressive gouging and scraping action that is advantageous for the rapid penetration of relatively soft formations.

However, it is rare that a formation interval will consist entirely of soft material with low compressive strength. Often, there are streaks of hard or abrasive materials that a steel-tooth bit must be able to penetrate economically and without damage to the bit.

Although steel teeth possess good strength, their abrasion resistance generally is not adequate to permit rapid penetration of hard or abrasive streaks without damage to the bit. Consequently, it is conventional in the art to provide a layer of wear-resistant material or hard-facing over at least a portion of the teeth of a steel tooth bit. These wear-resistant materials or hard-facings are conventional, and typically consist of particles of tungsten carbide or other hard metal dispersed in a steel, nickel, or cobalt binder matrix. Such hard-facing materials are applied by melting the binder of the hard-facing material and applying the material over the surfaces of the tooth. The proper application of hard-facing material to steel tooth bits requires considerable skill on the part of the welder.

The practice of hard-facing steel teeth was initiated in approximately 1929. With the introduction of the tungsten carbide insert (TCI) bit by Hughes Tool Company in the 1950's (see U.S. Pat. No. 2,687,875, Aug. 31, 1954, to Morlan, et al.), the focus of the drilling industry research turned to the use of TCI bits. More recently, attention again has focused on the improvement and development of earth-boring bits of the mill- or steel-tooth variety because of advances in hard-facing material and application technology.

It is difficult to apply a relatively thick layer of hard-facing material over the crest or ends of teeth within tolerance. A tooth with a crest hard-faced to a thickness beyond the tolerance can cause the tooth to interfere with or "strike" an opposing cone. This condition requires expensive and time-consuming grinding of the hard-faced crest to reduce the thickness and eliminate interference. At least as early as 1989, one corner of the steel teeth in one row was beveled to permit application of hard-facing without causing the aforementioned interference between teeth.

U.S. Pat. No. 5,152,194, Oct. 6, 1992, to Keshavan, et al. discloses a method of hard-facing a steel-tooth earth-boring bit, wherein a substantially uniform thickness of hard-facing is provided over the tooth. Each corner of each tooth is rounded to achieve uniform hard-facing thickness. That disclosure does not address the difficulty of applying a thick layer of hard-facing material over a tooth of a steel-tooth earth-boring bit without incurring the problem of tooth strike, which requires costly and time-consuming grinding operations to bring the hard-faced tooth within the clearances and tolerances necessary to avoid strike.

U.S. Pat. No. 2,660,405, Nov. 24, 1953 to Scott, et al., which is commonly owned, with this application, discloses a steel-tooth earth-boring bit in which one flank of a tooth is "gashed," or provided with a depression, which is filled with a hard-facing material to provide a self-sharpening tooth structure. The gashes extend from one end of the tooth to the other, which reduces the section modulus of the tooth, thereby weakening the steel tooth and increasing its susceptibility to failure due to bending and compressive loads applied to the crest and flanks of the tooth in drilling operations.

U.S. Pat. No. 2,058,753, Oct. 27, 1936 to Zublin discloses provision of a tooth of a steel-tooth earth-boring bit with a series of shallow grooves formed in the flank of the tooth that do not extend through the crest of the tooth. The metal in the grooves is melted and the grooves are filled with tungsten carbide particles, which are retained on the flank of the tooth when the molten metal in the grooves cools. These grooves cause a less drastic reduction in the strength of the tooth than the gashes proposed by Scott, et al., but do not address increasing the wear-resistance of the crest of the tooth. Moreover, the tooth resulting from the method disclosed by Zublin has tungsten carbide particles dispersed in only a portion of the flank of the tooth, i.e. where the grooves initially were formed.

It has been found that a high wear area exists at the intersections of the various surfaces of milled or steel teeth. An area that experiences particularly high wear is at the intersections of the leading flanks and outer ends of teeth, especially on heel teeth.

A need exists, therefore, for an earth-boring bit having a hard-faced steel tooth structure that provides improved wear-resistance at the crest, flanks, and ends of the tooth, while maintaining the structural integrity of the underlying steel tooth, as well as the original hard-faced tooth geometry as the tooth wears.

SUMMARY OF THE INVENTION

It is a general object of the present invention to provide an improved earth-boring bit having an improved hard-faced tooth structure.

This and other objects of the present invention are accomplished by providing an earth-boring bit having a bit body and at least one cutter rotatably secured to the bit body. The cutter includes a plurality of teeth formed integrally with the cutter and arranged in circumferential rows. Each tooth has inner and outer ends, leading and trailing flanks, and a crest transversely connecting the ends and flanks. A thickness of wear-resistant material is applied over the crest and at least a portion of the ends and flanks of the tooth. An extending layer of wear-resistant material is applied at least at the intersection of the leading flank and the outer end to provide approximately twice the hard-facing thickness and increased wear-resistance in that area of the tooth that is subjected to the greatest wear.

According to the preferred embodiment of the present invention, the extending layer of wear-resistant material is applied before the wear-resistant material elsewhere on the tooth is cooled to ambient temperature.

According to the preferred embodiment of the present invention, the tooth with the wear-resistant material has a depression formed at the intersection of the leading flank and outer end prior to application of the wear-resistant material.

According to the preferred embodiment of the present invention, the depression extends across the leading flank of the tooth to define a rib on the leading flank. The rib is thicker proximal the base of the tooth than it is proximal to the crest.

Other objects, features, and advantages of the present invention will become apparent to those having skill in the art with reference to the drawings and detailed description, which follow.

DESCRIPTION OF THE PREFERRED EMBODIMENT

Figure 1:
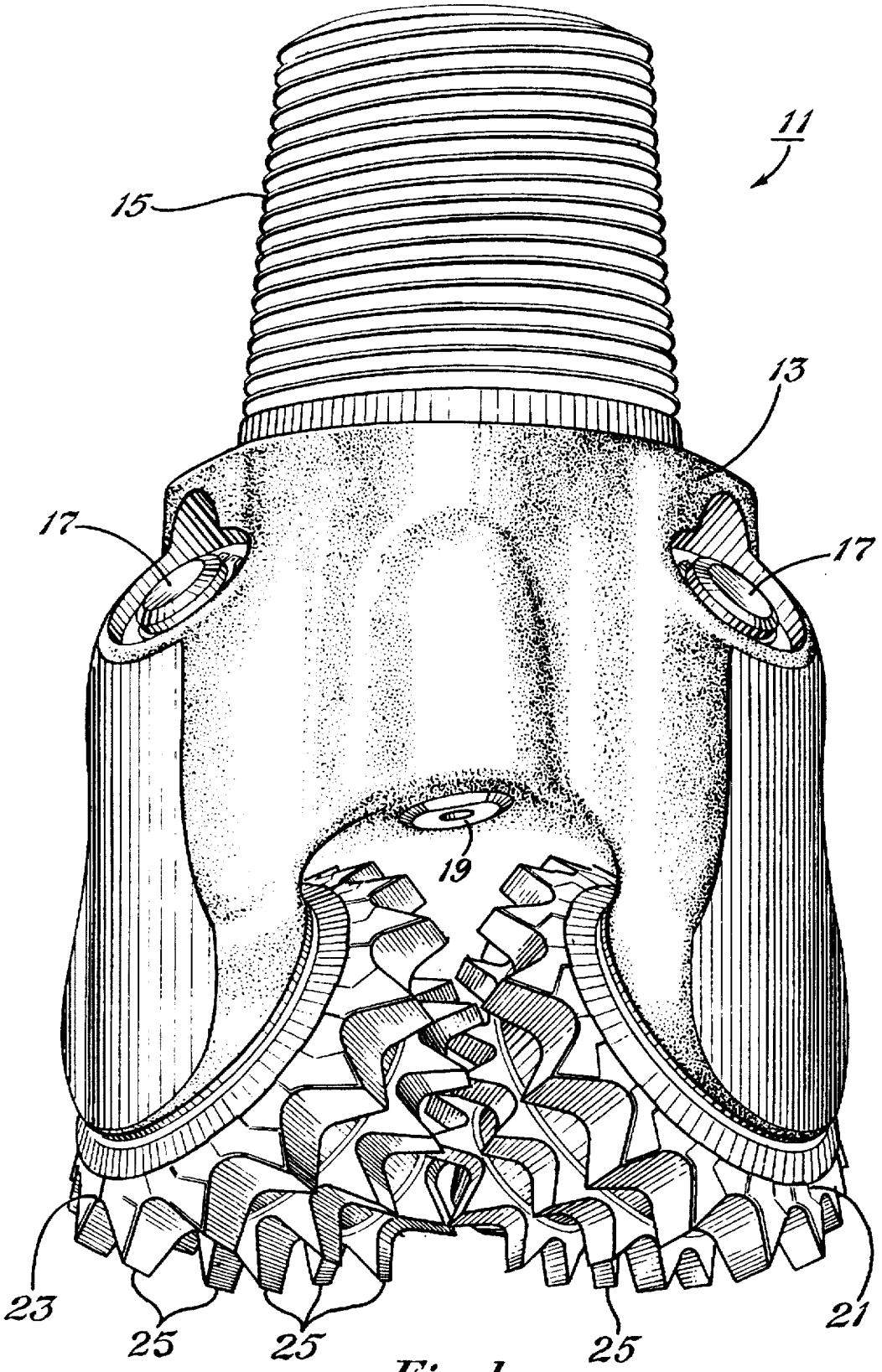
FIG. 1 is a perspective view of an earth-boring bit of the type contemplated by the present invention.

Referring now to FIG. 1, an earth-boring bit 11 according to the present invention is depicted. Earth-boring bit 11 includes a bit body 13 having threads 15 at its upper extent for connecting bit 11 into a drillstring (not shown). Each leg of bit 11 is provided with a lubricant compensator 17, a preferred embodiment of which is disclosed in U.S. Pat. No. 4,276,946, Jul. 7, 1981, to Millsapps. At least one nozzle 19 is provided in bit body 13 for spraying cooling and lubricating drilling fluid from within the drillstring to the bottom of the borehole.

At least one cutter, in this case three (one of which is obscured from view in the perspective of FIG. 1), 21, 23 is rotatably secured to each leg of bit body 13. A plurality of teeth 25 are arranged in generally circumferential rows on cutters 21, 23. Teeth 25 are integrally formed from the material of cutters 21, 23, which is usually steel.

Figure 2:
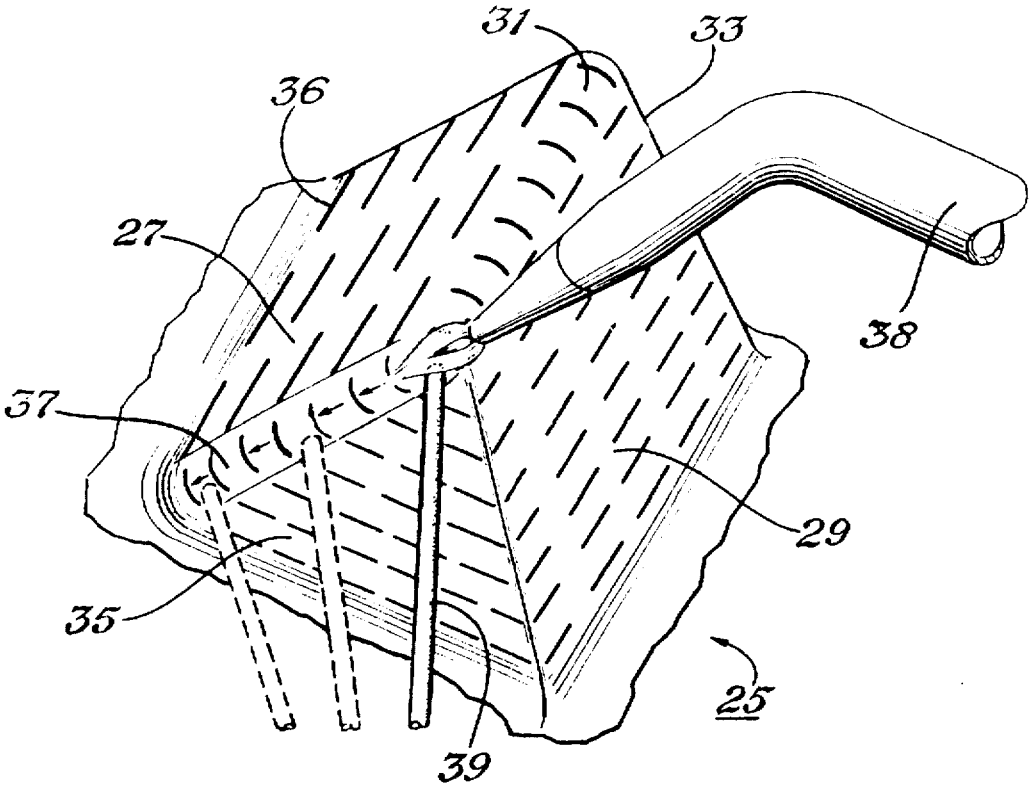
FIG. 2 is a fragmentary perspective view of a steel tooth of an earth-boring bit according to the present invention.

FIG. 2 is a perspective view of a tooth formed according to the present invention. A leading flank 27 and a trailing flank 29 converge to define a crest 31. Leading flank 27 is termed "leading" because it is the flank of tooth 25 that encounters formation material first as cutters 21, 23 roll and slide over the bottom of the borehole. Similarly, because trailing flank 29 trails behind leading flank 27, it is termed "trailing." Tooth 25 also includes an inner end 33 and an outer end 35. Inner end 33 is so named because it faces the center or center line of bit 11. Outer end 35 is so named because it faces the outer diameter of bit 11.

A thickness of wear-resistant material or hard-facing 36 is applied over at least crest 31, flanks 27, 29 and ends 33, 35 of tooth 25 to increase its wear-resistance. Hard-facing material 36 preferably is a mixture of cemented tungsten carbide spheres of 16–30 mesh and particles of crushed cemented tungsten carbide of 20–30 mesh and crushed cast tungsten carbide 60–80 mesh. The percent by weight of the above three tungsten carbide particles in the composition is respectively 66%, 15%, and 15%. The above particles are contained in a mild steel welding tube or rod along with silicomanganese of about 4% by weight and niobium of less than 1% by weight. The initial thickness of hard-facing layer 33 is preferably between about 0.060 and 0.125 inch.

At the intersection of leading flank 27 and outer end 35, an extending layer 37 of hard-facing material of the same composition is applied. Preferably, extending layer 37 extends from the crest to the base of tooth 25. For smaller, inner row teeth, extending layer preferably is approximately 0.250 inch in width. For larger, heel row teeth, extending layer 37 preferably is approximately 0.375 inch in width. The extending layer 37 results in a double thickness of hard-facing at the outer leading corner.

According to the preferred embodiment of the present invention, extending layer 37 is applied as a continuous bead beginning at crest 31 and extending generally to the base of tooth 25. Extending layer 37 is welded using an oxyacetylene torch 35 and hard-facing rods 39. The bead is applied in a forward direction, extending downwardly from crest 31 toward the base of tooth 25. It has been found that extending layer 37 should be applied as rapidly as possible after initial hard-facing layer 36 to avoid reheating and dissolution of carbide particles in initial layer 33, which results in a brittle matrix of extending layer 37. Although the precise temperature ranges for successful welding of extending layer 37 are not presently known, it should be applied well before initial layer 33 cools to room or ambient temperature.

Figure 3:
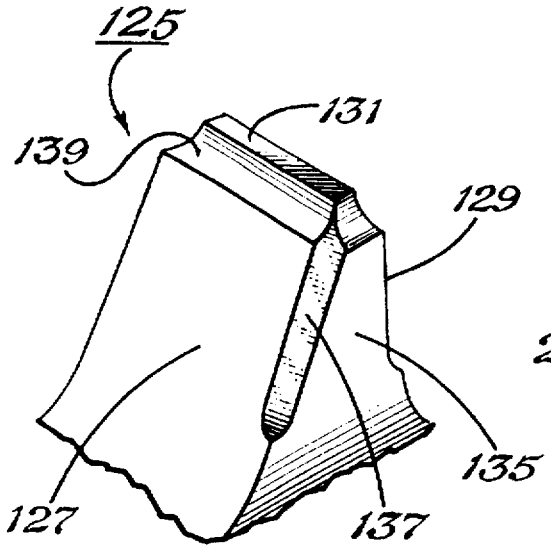
FIG. 3 is a fragmentary perspective view of a steel tooth of an earth-boring bit according to the present invention.

FIG. 3 is a perspective view of an underlying tooth geometry 125 prior to application of hard-facing, according to a preferred embodiment of the present invention. A depression 137 in the form of an 0.125 inch inverted radius is defined at the intersection of leading flank 127 and outer end 135. Additionally, a depression in the form of an 0.125 inch inverted radius 139 is provided at each intersection of flanks 127, 129 with crest 131. Depressions 137, 139 provide for thicker layers of hard-facing material over the depressions than elsewhere over tooth 125. The underlying steel tooth of FIG. 3 may be provided with both initial and extending hard-facing layers as described with reference to FIG. 2 to provide essentially triple-thickness hard-facing. Alternatively, tooth geometry 125 may be provided only with an initial hard-facing layer, the increased thicknesses of the hard-facing over depressions 137, 139 providing generally the same double or triple-thickness hard-facing as the initial and extending hard-facing layers described in connection with FIG. 2.

Figure 4:
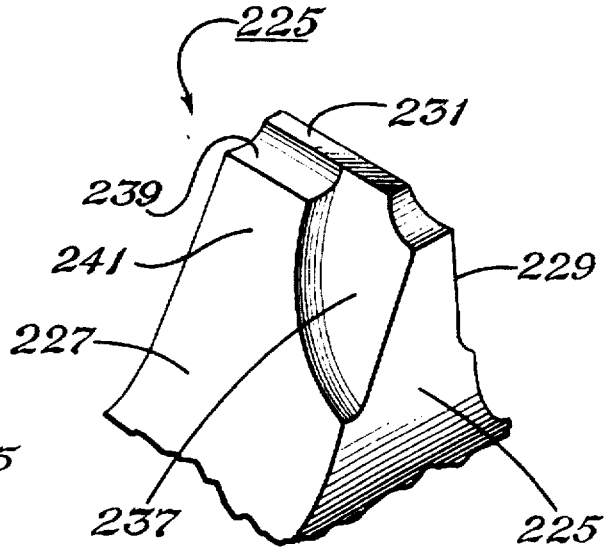
FIG. 4 is a fragmentary perspective view of a steel tooth of an earth-boring bit according to the present invention.

FIG. 4 is a perspective view of an underlying steel tooth geometry 225 according to a another preferred embodiment of the present invention. Similar to the embodiment of FIG. 3, tooth 225 is provided with a depression 237 at the intersection of leading flank 227 and outer end 235. In this embodiment, depression 237 extends across leading flank 227 to define a rib 241. The arcuate configuration of depression 237 causes rib 241 to be wider proximal the base and narrower proximal crest 231 of tooth 225. This configuration provides for an increased thickness of hard-facing material at the intersection of leading flank 227 and outer end 235 while providing a tooth having a satisfactory bending modulus and resistance to breakage. Similar to the embodiment of FIG. 3, the underlying tooth geometry of FIG. 4 may be provided with both initial and extending hard-facing layer to provide triple-thickness hard-facing. Alternatively, a single layer of hard-facing, with the increased thickness resulting from depression 237, will provide satisfactory properties.

Improved teeth 25 remain sharp because of their improved wear resistance, which results from the increased thickness of wear-resistant material over selected portions of tooth 25.

A principal advantage of the present invention is the provision of an earth-boring bit having improved wear resistance without sacrificing efficient, sharp tooth geometry and the resulting rate of penetration of the bit. In addition to improved wear resistance, the tooth of the earth-boring bit according to the present invention possess strength equivalent to conventional teeth because a geometry with good bending strength is preserved in the underlying steel tooth.

While the invention has been shown in only one of its preferred embodiments, it is thus not limited. It will be apparent to those having skill in the art that the present invention is subject to variation and modification without departure from the scope thereof.

We claim:

1. An improved earth-boring bit comprising:

a bit body;

at least one cutter rotatably secured to the bit body, the cutter including a plurality of teeth formed integrally with the cutter and arranged in circumferential rows on the cutter, each tooth having inner and outer ends, and leading and trailing flanks converging to define a crest;

a depression formed at an intersection of the leading flank and the outer end of at least one of the teeth, the depression having an inner edge on the leading flank and an outer edge on the outer end, the outer edge being proximal the leading flank;

a primary layer of wear-resistant material applied over the crest and at least a portion of the ends and flanks of at least one of the teeth; and an extending layer of wear-resistant material applied at the depression.

2. The improved earth-boring bit according to claim 1 wherein the extending layer of wear-resistant material is applied over the primary layer in the depression before the primary layer of wear-resistant material elsewhere on the tooth is cooled to ambient temperature.

3. The improved earth-boring bit according to claim 1 wherein the primary layer of wear-resistant material is applied in the depression and the extending layer of wear-resistant material is applied over the primary layer and fills the depression.

4. The improved earth-boring bit according to claim 3 wherein the thickness of the combined primary and extended layers of wear-resistant material over and filling the depression is twice the thickness of the primary layer of wear-resistant material elsewhere on the tooth.

5. The improved earth-boring bit according to claim 1 wherein the circumferential rows on the cutter comprises a heel row and at least one inner row, and wherein the depression is formed on a tooth on the inner row.

6. An improved earth-boring bit comprising:

a bit body;

at least one cutter rotatably secured to the bit body, the cutter including a plurality of teeth formed integrally with the cutter and arranged in circumferential rows on the cutter, each tooth having inner and outer ends, leading and trailing flanks converging to define a crest and a base;

a depression formed in at least one tooth at the intersection of the outer end and leading flank the depression having an inner edge on the leading flank and an outer edge on the outer end, the outer edge being proximal the leading flank and spaced from the trailing flank substantially a full width of the outer end;; and a thickness of wear-resistant material filling the depression and applied over at least the crest and a portion of the ends and flanks of the tooth, the thickness of the wear-resistant material over the depression being greater than elsewhere on the tooth to provide a more wear-resistant tooth.

7. The improved earth-boring bit according to claim 6 wherein the thickness of the wear-resistant material over the depression is twice the thickness of the wear-resistant material on the flanks and ends of the tooth.

8. The improved earth-boring bit according to claim 6 wherein the depression extends across the leading flank of the tooth to define a rib on the leading flank.

9. The earth-boring bit according to claim 8 wherein the rib is wider proximal the base of the tooth than proximal the crest of the tooth.

10. The improved earth-boring bit according to claim 6 wherein the thickness of wear-resistant material in the depression comprises a first layer of wear-resistant material and a second layer of wear-resistant material applied over the first layer before the first layer has cooled to ambient temperature.

11. The improved earth-boring bit according to claim 6 wherein the circumferential rows on the cutter comprises a heel row and at least one inner row, and wherein the depression is formed on a tooth on the inner row.

12. An improved earth-boring bit comprising:

a bit body;

at least one cutter rotatably secured to the bit body, the cutter including a plurality of teeth integrally formed with the cutter and arranged in circumferential rows on the cutter, each tooth having inner and outer ends, leading and trailing flanks converging to define a crest;

a rib formed in the leading flank of at least one of the teeth in at least one circumferential row, the rib adjacent the inner end of the tooth and extending from the base of the tooth to the crest, the rib being thicker proximal the base than proximal the crest, a portion of the leading flank adjacent the rib defining a depression; and a thickness of wear-resistant material filling the depression and applied over at least the crest and a portion of the ends and flanks of the tooth, wherein the thickness of the wear-resistant material over the depression is greater than elsewhere over the tooth.

13. The improved earth-boring bit according to claim 12 wherein the thickness of the wear-resistant material over the depression is double the thickness elsewhere on the tooth.

* * * * *